US009618302B2

(12) United States Patent
Kintzing

(10) Patent No.: US 9,618,302 B2
(45) Date of Patent: Apr. 11, 2017

(54) PICATINNY RAIL LINE OF SIGHT WEAPON SCOPE CAMERA MOUNT

(71) Applicant: Gregory Kyle Kintzing, Shreveport, LA (US)

(72) Inventor: Gregory Kyle Kintzing, Shreveport, LA (US)

( * ) Notice: Subject to any disclaimer, the term of this patent is extended or adjusted under 35 U.S.C. 154(b) by 0 days.

(21) Appl. No.: 15/052,202

(22) Filed: Feb. 24, 2016

(65) Prior Publication Data

US 2016/0245621 A1 Aug. 25, 2016

Related U.S. Application Data

(60) Provisional application No. 62/119,905, filed on Feb. 24, 2015.

(51) Int. Cl.

| | |
|---|---|
| ***F41G 11/00*** | (2006.01) |
| ***F41G 1/38*** | (2006.01) |
| ***F41J 5/10*** | (2006.01) |

(52) U.S. Cl.

CPC ..... *F41G 11/003* (2013.01); *F41G 1/38* (2013.01); *F41J 5/10* (2013.01)

(58) Field of Classification Search

CPC ..... F41G 11/003; F41G 1/38; F41G 11/001; F41G 11/002; F41G 11/004; F41G 11/005; G03B 17/561

USPC ..... 42/124, 125, 126, 127, 128; 396/428, 396/427, 420, 419

See application file for complete search history.

(56) References Cited

U.S. PATENT DOCUMENTS

| | | | | |
|---|---|---|---|---|
| 2,614,471 | A * | 10/1952 | Markowitz | G03B 15/041 248/205.1 |
| D302,697 | S * | 8/1989 | Parrish | 396/428 |
| 6,042,277 | A * | 3/2000 | Errington | G03B 15/05 248/187.1 |
| 6,991,384 | B1 * | 1/2006 | Davis | F16M 11/02 248/187.1 |
| 8,657,509 | B2 * | 2/2014 | Galik | F16M 11/045 396/426 |
| 8,690,460 | B2 * | 4/2014 | Kuehl | G02B 21/36 396/428 |
| 8,911,162 | B2 * | 12/2014 | Kuehl | G03B 29/00 396/428 |
| 2006/0179703 | A1 * | 8/2006 | Leatherwood | F41G 11/003 42/124 |
| 2008/0000463 | A1 * | 1/2008 | Holmberg | F41B 5/12 124/25 |
| 2008/0037110 | A1 * | 2/2008 | Gaber | F41G 1/32 359/353 |
| 2008/0087784 | A1 * | 4/2008 | Holmberg | F16M 11/04 248/309.1 |
| 2009/0255162 | A1 * | 10/2009 | Holmberg | F41G 11/003 42/106 |
| 2010/0313462 | A1 * | 12/2010 | Holmberg | F41C 27/00 42/124 |
| 2011/0116782 | A1 * | 5/2011 | Scott | G03B 17/00 396/428 |

(Continued)

*Primary Examiner* — Joshua Freeman

(74) *Attorney, Agent, or Firm* — Davis & Bujold PLLC; Michael J. Bujold

(57) ABSTRACT

A rifle camera mount comprises a Picatinny rail, a flat shaped L bracket attached to the Picatinny rail, an angled L shaped bracket attached to the flat shaped L bracket, and a fastener to attach a camera to the angled L shaped bracket.

19 Claims, 5 Drawing Sheets

(56) References Cited

U.S. PATENT DOCUMENTS

| | | | | |
|---|---|---|---|---|
| 2011/0308130 | A1* | 12/2011 | Holmberg | F41G 1/32 42/90 |
| 2012/0167437 | A1* | 7/2012 | Holmberg | A01K 89/08 42/90 |
| 2012/0167441 | A1* | 7/2012 | Holmberg | F41G 11/004 42/119 |
| 2012/0210624 | A1* | 8/2012 | Schneider | F41G 1/387 42/90 |
| 2012/0240444 | A1* | 9/2012 | Russell | F41C 27/00 42/90 |
| 2013/0251358 | A1* | 9/2013 | Kuehl | G02B 21/36 396/428 |
| 2013/0288743 | A1* | 10/2013 | Hunt | F41G 11/004 455/556.1 |
| 2014/0096429 | A1* | 4/2014 | Sandler | F41G 11/003 42/124 |
| 2014/0123532 | A1* | 5/2014 | Russ | F41G 1/38 42/113 |
| 2014/0226061 | A1* | 8/2014 | Kuehl | G02B 21/36 348/373 |
| 2014/0317987 | A1* | 10/2014 | Kuehl | G03B 29/00 42/90 |
| 2015/0309398 | A1* | 10/2015 | Volfson | G03B 17/566 396/530 |

* cited by examiner

PICATINNY RAIL LINE OF SIGHT WEAPON SCOPE CAMERA MOUNT

CROSS REFERENCE TO RELATED APPLICATIONS

This application claims priority to U.S. Provisional Patent Application No. 62/119,905 filed Feb. 24, 2015, the contents of which are incorporated herein by reference in its entirety. To the extent that there is any conflict between the incorporated material and the present disclosure, the present disclosure will control.

FIELD OF THE INVENTION

The present invention relates to a mount for viewing through a camera down a scope of a rifle or other weapon.

BACKGROUND

Individuals wishing to take photographs of images shown through the scope of a rifle do not now have a means to quickly, and securely photograph or video such images. The camera must be manually retrieved from a pocket and held with one hand while the rifle is held with another hand. This causes unsteadiness in the image and aim, potential danger with the decreased control of the rifle, and potential damage to the rifle and/or the camera.

SUMMARY

The present invention is directed to methods and apparatuses that satisfy this need, and overcome the above mentioned shortcomings and drawbacks associated with the current technology. The methods and apparatuses comprise a camera mount that includes a Picatinny rail. A flat shaped L bracket is attached to the Picatinny rail. An angled L shaped bracket is attached to the flat shaped L bracket. A fastener is also provided to attach a camera to the angled L shaped bracket.

A benefit of the camera mount is to allow for secure attachment of a camera to a rifle that insures no damage to the weapon or the weapon's scope. It allows for secure positioning and allows the mount to be taken on and off without losing desired camera to scope positioning.

Various objects, features, aspects, and advantages of the present invention will become more apparent from the following detailed description of preferred embodiments of the invention, along with the accompanying drawings in which like numerals represent like components.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. It is to be appreciated that the accompanying drawings are not necessarily to scale since the emphasis is instead placed on illustrating the principles of the invention. The invention will now be described, by way of example, in which.

DETAILED DESCRIPTION

Figure 1:
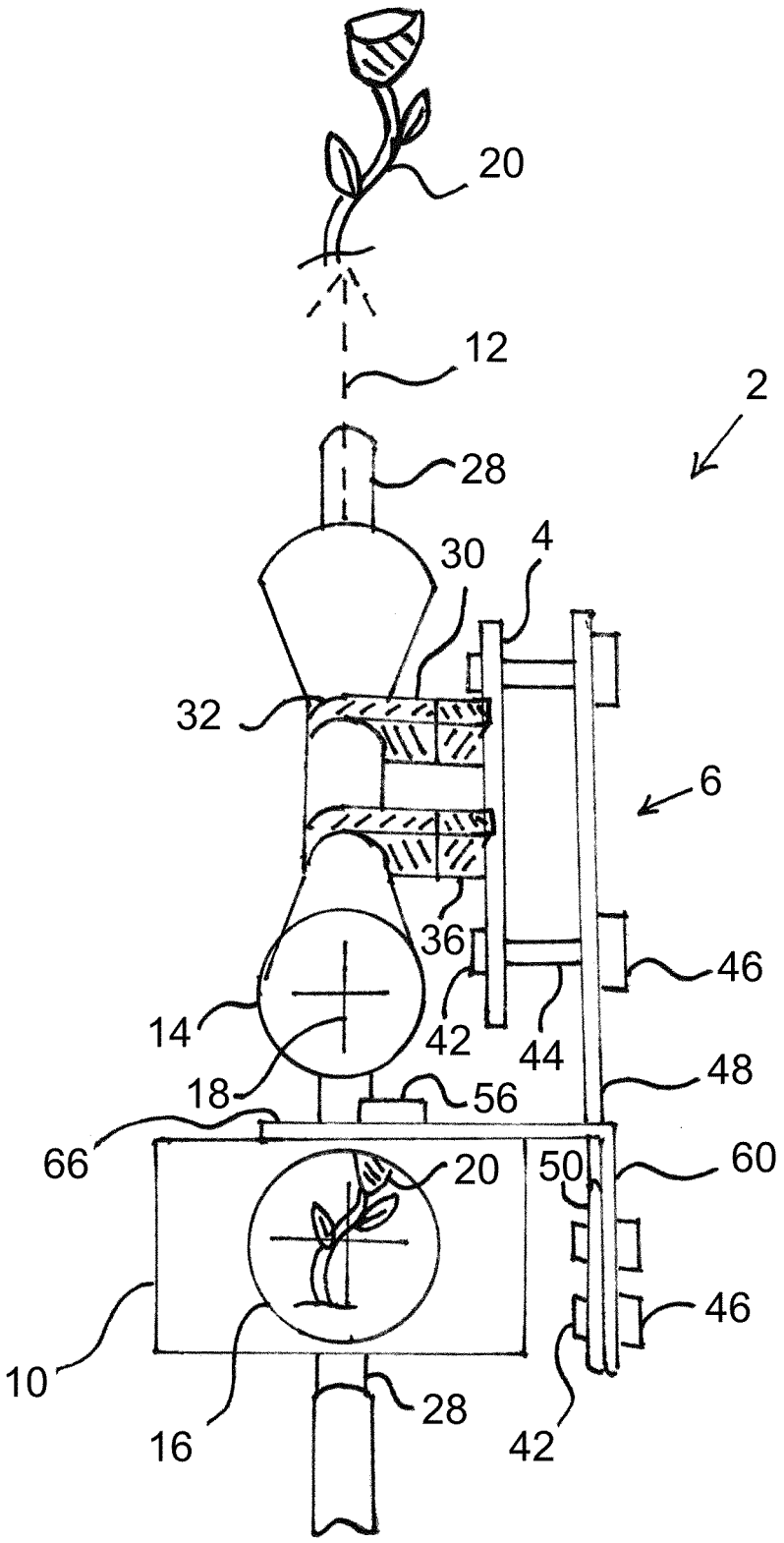
FIG. 1 is a rear perspective view of a first embodiment of a weapon scope camera mount according to the present invention.

The present invention will be understood by reference to the following detailed description, which should be read in conjunction with the appended drawings. It is to be appreciated that the following detailed description of various embodiments is by way of example only and is not meant to limit, in any way, the scope of the present invention.

Turning now to FIGS. 1-5, a brief description concerning the various components of the present invention will now be briefly discussed. As can be seen in this embodiment, the disclosed weapon scope camera mount 2 includes the Picatinny rail 4, a flat L bracket 6, and an angled L bracket 8. The weapon scope camera mount 2 incorporates a Picatinny rail 4, allowing various types of cameras 10, including film and digital cameras, camcorders, and mobile computing devices with cameras (such as smart phones, iPhones® and tablet computers, for example) to be placed in the line of sight 12 of the scope 14 to capture the perceived image 16 that is portrayed in the weapon scope 14 itself, including the view of the weapon scope reticle 18 over the targeted subject 20.

The Picatinny rail 4 is a bracket that provides a standard mounting platform for accessories and attachments. The Picatinny rail 4 shown is 13" in length, though longer and shorter embodiments are envisioned. The Picatinny rail 4 is also known as a MIL-STD-1913 rail, Standardization Agreement 2324 rail, or tactical rail. The Picatinny rail 4 consists of a strip provided with crosswise notches 22 at intervals interspersed with flats that allow accessories to be slid into place from the end of the Picatinny rail 4 then locked in place or slid into the notches 22 between raised flats 24 then moved a short distance back or forth or clamped to the Picatinny rail 4 with clamps 26 comprising bolts, screws, levers, or the like.

The Picatinny rail 4 facilitates the attachment of the weapon scope camera mount 2 to the scope 14 of the weapon 28 via two, preferably axially spaced, ring mounts 30 oriented ninety degrees to the line of sight 12 of the scope 14. In the embodiment shown, the line of sight 12 may also be interpreted as an axis of the scope. A single ring mount 30 may be used, but it would provide a less robust connection for the weapon scope camera mount 2. Each ring mount 30 is securely attached to and encircles a circumference of the scope 14 with a respective circumferential retainer 32. The ring mount 30 also includes a rail engaging surface 34 and a clamp 26 by which the ring mount 30 may be securely mounted directly on the Picatinny rail 4. Alternatively, each ring mount 30 may be securely mounted on a respective riser mount 36 that is itself mounted on the Picatinny rail 4. The riser mount has a rail 38 on an upper surface, which accepts the rail engaging surface 34 of the ring mount 30. Preferably opposite to the rail 38, on a lower surface, the riser mount has a rail engaging surface 34 and a clamp 26, to securely mount onto the either the Picatinny rail 4 or to another riser mount 36 which is itself securely mounted to the Picatinny rail 4.

Figure 2:
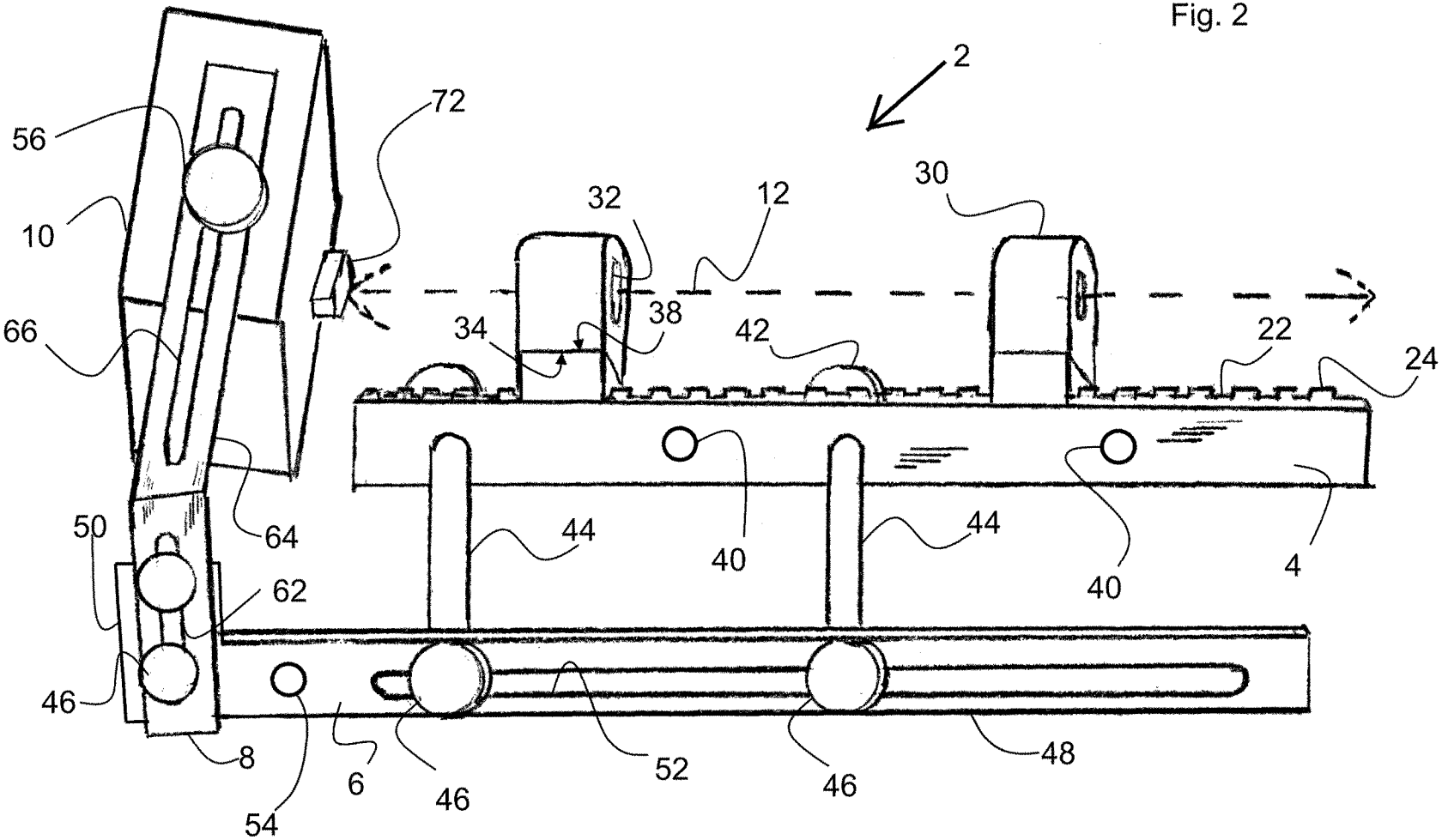
FIG. 2 is a side perspective view of the weapon scope camera mount of FIG. 1, with the weapon and scope removed for clarity.

The Picatinny rail 4 has attachment holes 40, ¼" in size in the embodiment shown, which are drilled through the Picatinny rail 4 to attach the flat L bracket 6 to Picatinny rail 4. The Picatinny rail 4 can be attached directly adjacent to the flat L bracket 6 with short thumb screws 42. Alternatively, as shown in FIGS. 1 and 2, preferably cylindrical spacers 44 can horizontally space the Picatinny rail 4 from the flat L bracket 6, with long thumb screws 42 passing through a through passage 45 in the spacers 44 and being secured with a check nut 46.

Four attachment holes 40 are shown in the Picatinny rail 4 in the embodiment shown, to allow multiple locations to attach the Picatinny rail 4, though four are not required. Preferably, at least two attachment holes 40 are provided to help minimize relative rotation between the Picatinny rail 4 and the flat L bracket 6, and more preferably at least three attachment holes 40 are provided to additionally allow for multiple locations of attachment depending on the situation. A single attachment hole 40 could be used, though with a single attachment hole 40, elements to minimize relative rotation between the flat L bracket 6 and the Picatinny rail 4 would preferably be provided.

The flat L bracket 6 is a fabricated bracket. In the embodiment shown, the flat L bracket 6 preferably measures 13" by 2", with 13" along a first flat L section 48 and 2" along a second flat L section 50 extending orthogonally from the first flat L section 48. In the embodiment shown, the first flat L section 42 is longer than the second flat L section 50, but, while preferable, this is not necessary. In the first flat L section 48, a flat L slot 52 extends down length of the first flat L section 48. The flat L slot 52 shown measures ¼" wide and about 9" to 11" long. In the first flat L section 48, adjacent to the area of the flat L bracket 6 where the second flat L section 50 extends from the first flat L section 48, a threaded hole 54 is preferably provided. In the embodiment shown the threaded hole measures ¼" wide. The threaded hole is sized to retain the camera screw 56 for when the camera 10 is not in use.

The second flat L section 50 extends preferably at a right angle from the first flat L section 48, and has one or more through holes 58. In the embodiment shown, the second flat L section 50 has two ¼" through holes 58. The flat L bracket 6 controls both lateral placement from scope 14 (e.g., via spacers 44 used, if any) and the distance the camera 10 is placed behind scope 14.

The angled L bracket 8, as shown, is a fabricated bracket and preferably measures 3"×5". The 3" first angled L section 60 has a first angled L slot 62, shown here as ¼" wide and approximately 2.5" long The 5" second angled L section 64 similarly has a second angled L slot 66, shown here measuring ¼" wide and approximately 4.5" long. The angled L bracket 8 allows attachment of camera 10 with limited horizontal movement—where horizontal movement can be perpendicular to line of site 12, and can be parallel to the elongate direction of the spacers 44, if any, and the ring mounts 30. The first angled L section 60 of the angled L bracket 8 is attached to second flat L section 50 of the flat L bracket 6 with limited vertical movement of the angled L bracket 8 on the flat L bracket 6.

Figure 3:
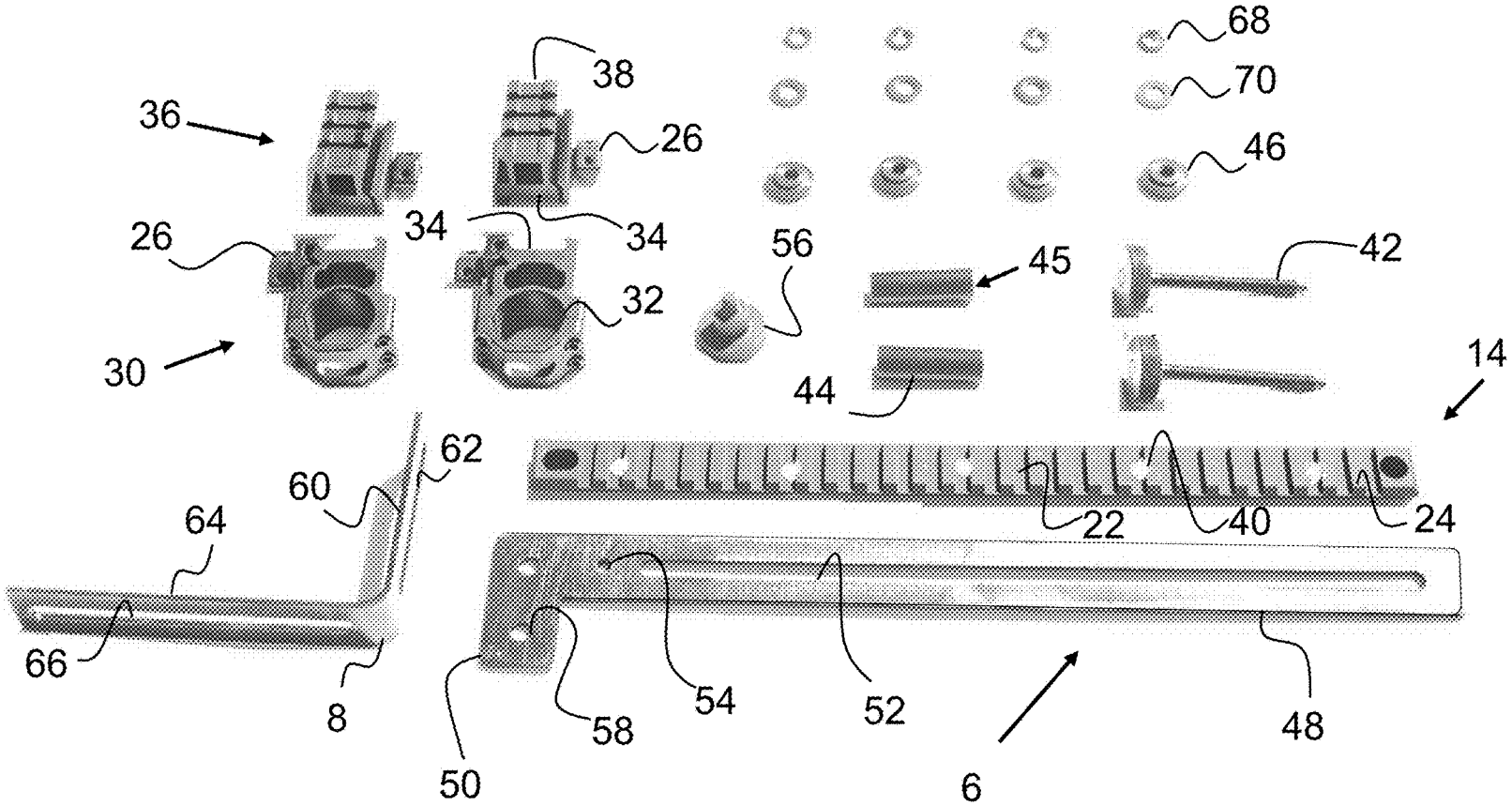
FIG. 3 is a perspective view of the disassembled various parts of the weapon scope camera mount of FIG. 2, with two short thumb screws omitted.
Figure 4:
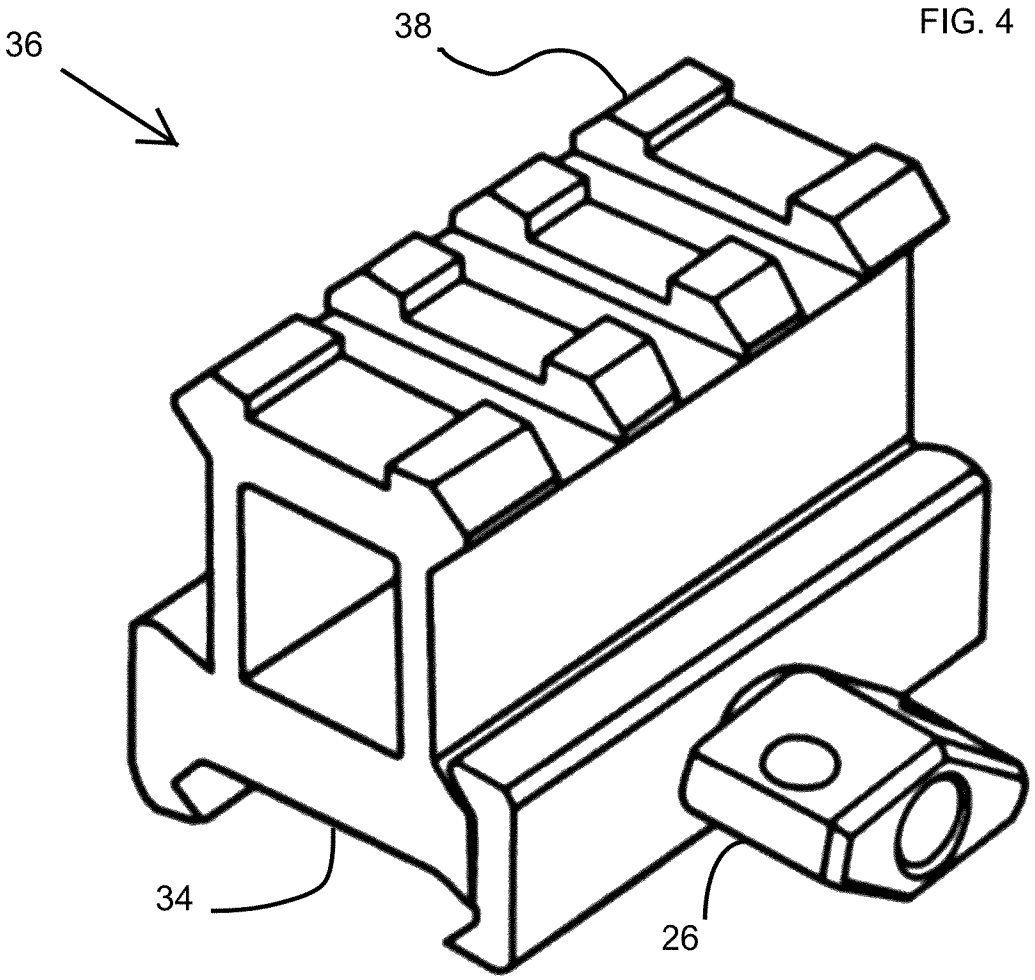
FIG. 4 is a perspective view of a riser mount of FIG. 3.
Figure 5:
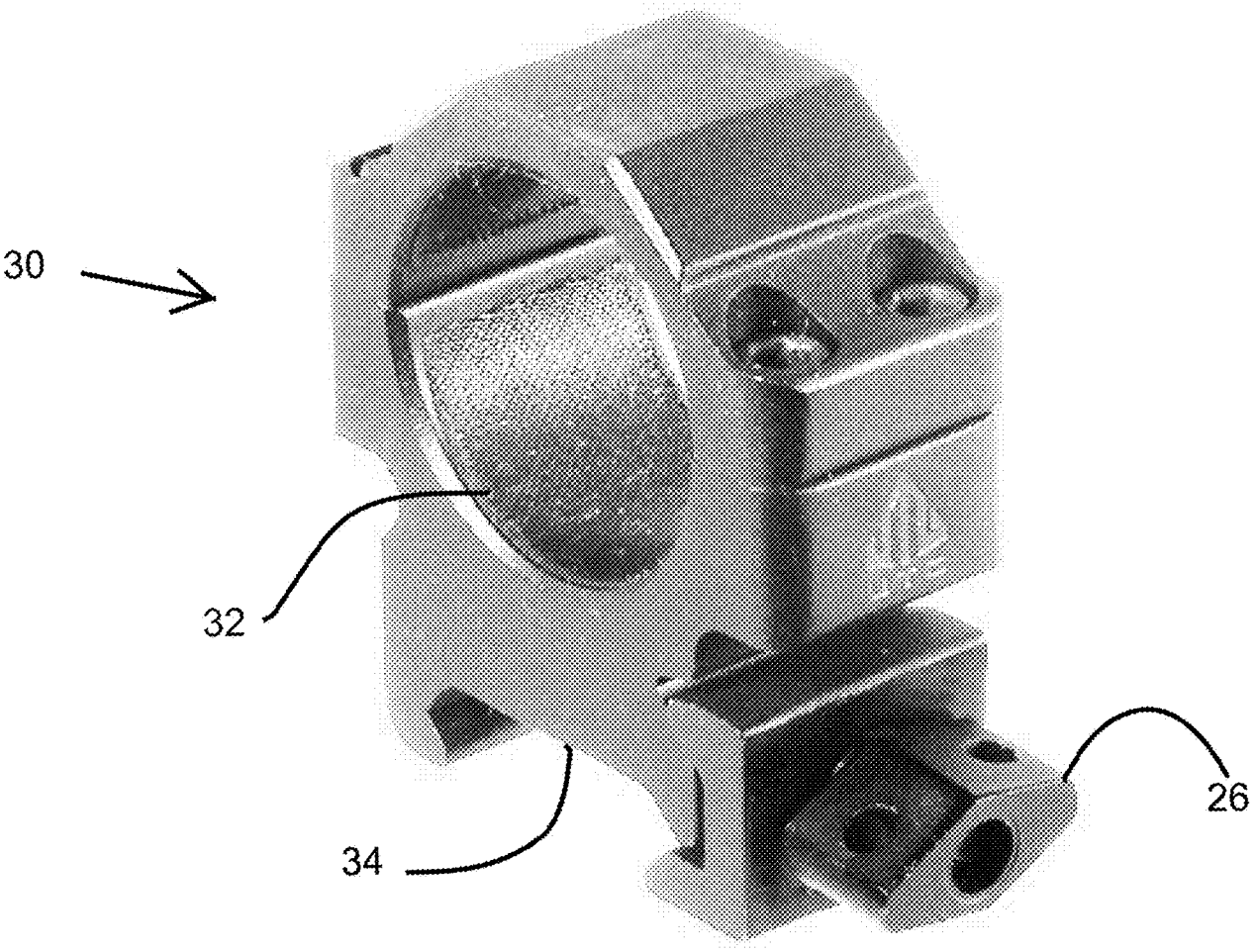
FIG. 5 is a perspective view of a ring mount of FIG. 3.

Four ¼-20 thumb screws 42 are used to attach the weapon scope camera mount 2 to the Picatinny rail 4, though only two are shown in FIG. 3. The length of the thumb screws 42 varies depending on needed spacing of the flat bracket 6 from Picatinny rail 4. Two longer ¼-20 thumb screws 42 attach the flat L bracket 6 to the Picatinny rail 4 in the embodiment shown. Another two shorter ¼-20 thumb screws 42 attach the angled L bracket 8 to the flat L bracket 6. It is to be appreciated that though ¼-20 screws are used widely in the disclosed embodiments, screws of different dimensions may be used, and holes 58, slots 52, 62, 66 and the like would then likewise be sized appropriately.

The weapon scope camera mount further preferably includes four ¼" check nuts 46. Thumb and knurled nuts may also be used for the check nuts 46. Four ¼" lock washers 68 used between all flat washers 70 and check nuts 46 or head of thumb screws. Additionally, preferably eight ¼" flat washers 70 are used between all lock washers 68 and brackets 6, 8 and between brackets 6, 8 and check nuts 46. The first two ¼" check nuts 46 secure the flat L bracket 6 to the thumb screws 42 from the Picatinny rail 4. The second two ¼" check nuts 46 secure the angled L bracket 8 to thumb screws 42 from the flat L bracket 6.

An optional number of additional spacers 44, as described above, measuring, for example, ¼" inside diameter of the through passage 45, ½" outside diameter, and 1" length are also included. The spacers 44 may be placed between the Picatinny rail 4 and the flat L bracket 6 when needed to provide sufficient lateral distance from scope 14 to allow alignment of the camera 10 with the weapon scope 14. The thumb screw 42 passes in and through the through passage 45.

Finally one or two ¼-20×5/16", for example, camera thumb screws or camera screws 56 are provided to attach the camera 10 to the second angled L section 64 of the angled L bracket 8. The fully assembled weapon scope camera mount 2, with spacers 44, is shown in FIG. 2, and the fully assembled weapon scope camera mount 2 attached to a scope 14 of rifle 28 is shown in FIG. 1

The Picatinny rail 4 is used to attach the weapon scope camera mount 2 to the two rings mounts 30 oriented approximately a right angle to the axis of the scope, which is coaxial with the line of sight 12. The flat L bracket 6 is attached to the Picatinny rail 4 using thumb screws 42 with optional spacers 44. The spacers 44 would be used if more lateral displacement of the weapon scope camera mount 2 is necessary to ensure the camera lens 72 is in line with line of sight 12 of the weapon scope 14. The flat L bracket 6 can then slide forward and backward to obtain necessary distance needed for the camera 10 to be at optimal focus behind the weapon scope 14. The angled L bracket 8 is then attached to the flat L bracket 6 using thumb screws 42. The first angled L slot 62 allows for vertical movement of the angled L bracket 8 on the flat L bracket 6 to obtain necessary vertical alignment of the camera 10 with the weapon scope 14. The second angled L slot 66 allows for movement of the camera 10 to obtain necessary horizontal alignment of the camera lens 72 behind the weapon scope 14, lining up the lens 72 with the line of sight 12. The camera 10 is attached to the second angled L section 8 via a camera thumb screw or camera screw 56.

It is envisioned that one could use different types of bolts or screws, nuts, and washers to achieve different positioning of the brackets 6, 8. One could use regular bolts instead of thumb screws 42 if the individual did not wish to have the flexibility to change bracket 6, 8 positioning with the ease of a thumb screw 42.

The weapon scope camera mount 2 can be assembled in multiple configurations with various spacers 44 to allow for many different types of cameras 10 (including camcorders and mobile devices) to be attached so that substantially perfect alignment of the camera lens 72 can be obtained through the line of sight 12 of the weapon scope 14 so that the weapon scope reticle 18 and the weapon scope target 20 can both be captured simultaneously for enlarged view check on camera displays, capture of still photos, and capture of live video footage.

A benefit of the flat L bracket 6 having matching top and bottom surfaces is that the weapon scope camera mount 2 may be easily used for right handed users, mounted to the left hand side of the scope 14, and for left hand users, mounted to the right hand side of the scope 14.

Most digital and film cameras 10 and camcorders include a female threaded receptacle for attaching the camera to a tripod. The camera screw 56 screws into the receptacle to secure the camera onto the second angled L section 64. For camera functioning electronics that are not provided with such a mounting female threaded receptacle, such as some smart phones and tablet computers, an adaptor is preferably provided. The adaptor will preferably be provided with a sized receptacle and will securely clamp two or more surfaces or edges of the non-reseptacled camera.

Next, a locking pivoting mount is anticipated. The kick-back and other forces a mounted camera 10 must endure are significant. Therefore, a locking pivot attaching the first angled L section 60 to the second angled L section 64 is disclosed. When the pivot is unlocked, the camera 10 may rotate (while still attached to the second angled L section 64) from a viewing position shown in FIG. 1 away from the viewing position. The camera 10 and second angled L section 64 may pivot along a plane defined by the first and second angled L sections 60, 64, or the camera 10 and the second angled L section 64 may pivot back toward the user, about an axis defined by the first angled L section 60, to a stowed position, or the camera 10 and the second angled L section 64 may pivot back toward the user, about an axis defined by the second angled L section 64, to a stowed position. Once the camera 10 is in the stowed position, the camera 10 will preferably be releasably locked in that position. The pivot may be spring biased to automatically rotate and lock the camera 10 into or out of the stowed position or the viewing position, depending on the desired usage, and automatically lock when the spring biased position is reached. Preferably a button on the pivot is depressed to release the lock and allow the camera 10 to be pivoted into viewing position or out of viewing position. According to a further pivot embodiment, the pivot could be located in the area of the intersection of the first flat L section 48 and the second flat L section 50, allowing the camera to pivot accordingly.

Continuing, the pivot may be motorized with an electric motor, with or without the spring bias. In this way, the user merely pushes an actuating button to cause the pivot lock to unlock and the camera 10 to pivot from the viewing position to the stowed position and lock, or vise versa. This increases the safety of the weapon scope camera mount 2 requiring far less movement from the user to put the camera 10 in the line of sight and remove the camera 10 from the line of sight. Preferably the motor would be actuated by an electrically connected button or switch located on the angled L bracket 6, for example. Alternatively, the motor may be controlled remotely with button positioned by the trigger of the weapon 28. Additionally, the motor may be controlled via Bluetooth or other wireless connection to the camera 10 or a wireless device, e.g. cell phone, iPhone, iPad. In this way, the user could just touch a "button" on the screen of a cellphone, and the camera 10 would flip in place, or out of the way.

While various embodiments of the present invention have been described in detail, it is apparent that various modifications and alterations of those embodiments will occur to and be readily apparent to those skilled in the art. This includes the use of the mount on cross bows and various other devices or especially elongate devices equipped with a scope. Additionally, although the present invention is ideally suited for devices with scopes, it may be used in non-scoped devices also to record the natural non-magnified view along the device. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items while only the terms "consisting of" and "consisting only of" are to be construed in the limitative sense.

Wherefore, I claim:

1. A weapon scope camera mount comprising:

a Picatinny rail;

a flat shaped L bracket attached to the Picatinny rail;

an angled L shaped bracket attached to the flat shaped L bracket; and a plurality of mechanical fasteners removably attaching the Picatinny rail to the flat shaped L bracket.

2. The weapon scope camera mount of claim 1 further comprising one of a slot and a hole in the angled L shaped bracket to attach a camera to.

3. The weapon scope camera mount of claim 1 further comprising means to attach a camera to the angled L shaped bracket.

4. The weapon scope camera mount of claim 1 further comprising one or more ring mounts sized to connect the Picatinny rail to a weapon scope.

5. The weapon scope camera mount of claim 4 further comprising two ring mounts axially spaced from one another, each ring mount securely attached to the weapon scope.

6. The weapon scope camera mount of claim 5 wherein each of the two ring mounts are securely attached to a respective riser mount, and each riser mount is securely attached to the Picatinny rail.

7. The weapon scope camera mount of claim 1 wherein the fasteners include one of screws and bolts.

8. The weapon scope camera mount of claim 1 further comprising a slot along a length of the flat L shaped bracket to removeably attach, in various locations along the slot, the Picatinny rail to the flat L shaped bracket.

9. The weapon scope camera mount of claim 1 further comprising a first slot along a length of the angled L shaped bracket to removeably attach, in various locations along the slot, the angled L shape bracket to the flat L shaped bracket.

10. The weapon scope camera mount of claim 1 further comprising a second slot along a length of the angled L shaped bracket to removeably attach, in various locations along the second slot, a camera.

11. The weapon scope camera mount of claim 1 further comprising means to securely locate a lens of an attached camera coincident with a line of sight of a weapon scope.

12. The weapon scope camera mount of claim 1 further comprising spacers spacing the Picatinny rail from the flat L shaped bracket.

13. The weapon scope camera mount of claim 1 wherein a first section of the flat L shaped bracket extends in a first direction, a second section of the flat L shaped bracket extends in a second direction orthogonal to the first direction, the first direction is parallel to a line of sight, and the second direction is perpendicular to the line of sight.

14. The weapon scope camera mount of claim 1 wherein a first section of the angled L shaped bracket extends in a primary direction, a second section of the angled L shaped bracket extends in a secondary direction, orthogonal to the primary direction, and both the primary direction and secondary direction are perpendicular to a line of sight.

15. The weapon scope camera mount of claim 1 wherein a first section of the angled L shaped bracket extends in a primary direction, a second section of the angled L shaped bracket extends in a secondary direction, and respective slots are disposed along at least a majority of a length of both the first section and the second section.

16. A method of mounting a camera to a weapon scope with a weapon scope camera mount having a Picatinny rail, a flat shaped L bracket attached to the Picatinny rail, an angled L shaped bracket attached to the flat shaped L bracket, and a plurality of mechanical fasteners removably attaching the Picatinny rail to the flat shaped L bracket the method comprising:

attaching the camera to the angled L shape bracket.

17. The method of claim 16, further comprising the steps of passing a threaded portion of a camera screw from a first side of the angled L shaped bracket to a second side of the angled L shaped bracket; and screwing the camera screw into a female threaded receptacle in the camera.

18. The method of claim 16, further comprising the steps of pivoting the camera from a viewing position to a stowed position while the camera is still securely connected to the angled L shaped bracket.

19. A weapon scope camera mount comprising:

a Picatinny rail;

a flat shaped L bracket attached to the Picatinny rail;

an angled L shaped bracket attached to the flat shaped L bracket;

one of a slot and a hole in the angled L shaped bracket to attach a camera to:

two axially spaced ring mounts each sized to receive an exterior circumference in an circumferential retainer;

each of the two ring mounts being securely attached to a respective riser mount;

each riser mount being securely attached to the Picatinny rail; and a plurality of mechanical fasteners removably attaching the Picatinny rail to the flat shaped L bracket.

* * * * *